US008007553B2

(12) United States Patent
Cho et al.

(10) Patent No.: US 8,007,553 B2
(45) Date of Patent: Aug. 30, 2011

(54) CEILING TYPE AIR CONDITIONER

(75) Inventors: Min Chul Cho, Changwon-si (KR); Kyoung Jun Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 311 days.

(21) Appl. No.: 12/219,551

(22) Filed: Jul. 23, 2008

(65) Prior Publication Data

US 2009/0188268 A1 Jul. 30, 2009

(30) Foreign Application Priority Data

Jan. 24, 2008 (KR) ..... 10-2008-0007568

(51) Int. Cl.
*B01D 46/42* (2006.01)

(52) U.S. Cl. ..... 55/283; 55/289; 55/296; 55/385.2; 55/471

(58) Field of Classification Search ..... 55/289, 55/283, 290, 471, 472, 473, 351, 352, 353, 55/354, 295, 296, 297, 298, 299, 300
See application file for complete search history.

(56) References Cited

U.S. PATENT DOCUMENTS

| | | | | |
|---|---|---|---|---|
| 2,012,250 | A * | 8/1935 | Rundell | 131/314 |
| 2,639,780 | A * | 5/1953 | Hardy | 55/296 |
| 3,252,691 | A * | 5/1966 | Getzin et al. | 261/80 |
| 3,487,620 | A * | 1/1970 | Klein et al. | 96/277 |
| 4,435,909 | A * | 3/1984 | Williamson, Jr. | 34/82 |
| 5,143,529 | A * | 9/1992 | Means, Jr. | 55/290 |
| 5,217,513 | A * | 6/1993 | Armbruster | 96/414 |
| 5,762,689 | A * | 6/1998 | Hunziker | 95/280 |
| 5,827,338 | A * | 10/1998 | Horvat | 55/285 |
| 7,276,108 | B2 * | 10/2007 | Wei et al. | 95/282 |
| 7,544,223 | B2 * | 6/2009 | Oda et al. | 55/289 |
| 2010/0107575 | A1 * | 5/2010 | Zhang et al. | 55/289 |

FOREIGN PATENT DOCUMENTS

| | | |
|---|---|---|
| CN | 101052845 | 10/2007 |
| JP | 2005-061742 | 3/2005 |
| JP | 2007-292397 | 11/2007 |
| JP | 2008-111599 | 5/2008 |
| WO | WO 2006/051739 A1 | 5/2006 |

* cited by examiner

*Primary Examiner* — Duane Smith
*Assistant Examiner* — Minh-Chau Pham
(74) *Attorney, Agent, or Firm* — McKenna Long & Aldridge LLP

(57) ABSTRACT

There is provided a ceiling type air conditioner capable of controlling the operation of at least one of a moving unit for moving a brush assembly or a suctioning unit for suctioning foreign matters stored in the brush assembly based on the position of the brush assembly for collecting and storing the foreign matters filtered by a filter. Therefore, it is possible to properly control the movement of the brush assembly to effectively collect and store the foreign matters filtered by the filter. In addition, since a user does not have to exchange or clean the filter, it is possible to prevent inconvenience from being caused by exchanging or cleaning the filter and to prevent the filter from being contaminated.

12 Claims, 10 Drawing Sheets

CEILING TYPE AIR CONDITIONER

This non-provisional application claims priority under 35 U.S.C. §119(a) on Patent Application No. 10-2008-0007568 filed in Republic of Korea on Jan. 24, 2008, the entire contents of which are hereby incorporated by reference.

BACKGROUND OF THE INVENTION

1. Field of the Invention

The present invention relates to a ceiling type air conditioner, and more particularly, to a ceiling type air conditioner capable of controlling the operation of at least one of a moving unit for moving a brush assembly or a suctioning unit for suctioning foreign matters stored in the brush assembly based on the position of the brush assembly for collecting and storing the foreign matters filtered by a filter.

2. Discussion of the Related Art

Generally, a ceiling type air conditioner includes an indoor unit provided on a ceiling to perform a cooling function, an outdoor unit for performing heat radiation and compression functions, and a refrigerant tube for connecting the indoor unit and the outdoor unit to each other. The indoor unit is provided in an internal space on a ceiling.

However, in a conventional ceiling type air conditioner, the foreign matters of the air introduced to the indoor unit are accumulated on the indoor unit so that the components in the indoor unit are not sufficiently protected and that the air in a room to be air conditioned is contaminated.

Furthermore, when the foreign matters in the air suctioned into the ceiling type air conditioner are filtered, the amount of the foreign matters collected by a filter increases so that the flow of the air that passes through the indoor unit is prohibited to deteriorate the function of the ceiling type air conditioner. Since the filter is to be detachably installed in order to exchange and clean the filter, the installation position of the filter, the installation method of the filter, and the layout of the components around the filter are limited. In addition, since a user must exchange and clean the filter, due to the inconvenience caused by exchanging and cleaning the filter and the unpleasant feeling caused by the contamination of the filter, sensitivity quality deteriorates.

SUMMARY OF THE INVENTION

It is an object of the present invention to provide a ceiling type air conditioner capable of controlling the operation of at least one of a moving unit for moving a brush assembly or a suctioning unit for suctioning foreign matters stored in the brush assembly based on the position of the brush assembly for collecting and storing the foreign matters filtered by a filter.

A ceiling type air conditioner according to the present invention comprises a filter housing in which a filter is settled, a brush assembly coupled to the filter housing to collect foreign matters filtered by the filter, a moving unit for moving the brush assembly along the filter housing, a suctioning unit for suctioning the foreign matters collected by the brush assembly, and a controlling unit for controlling an operation of at least one of the moving unit and the suctioning unit.

The ceiling type air conditioner according to the present invention can properly control the movement of the brush assembly to effectively collect and store the foreign matters filtered by the filter. In addition, since a user does not have to exchange or clean the filter, it is possible to prevent inconvenience from being caused by exchanging or cleaning the filter and to prevent the filter from being contaminated.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Hereinafter, embodiments of a ceiling type air conditioner according to the present invention will be described in detail with reference to the accompanying drawings.

Figure 1:
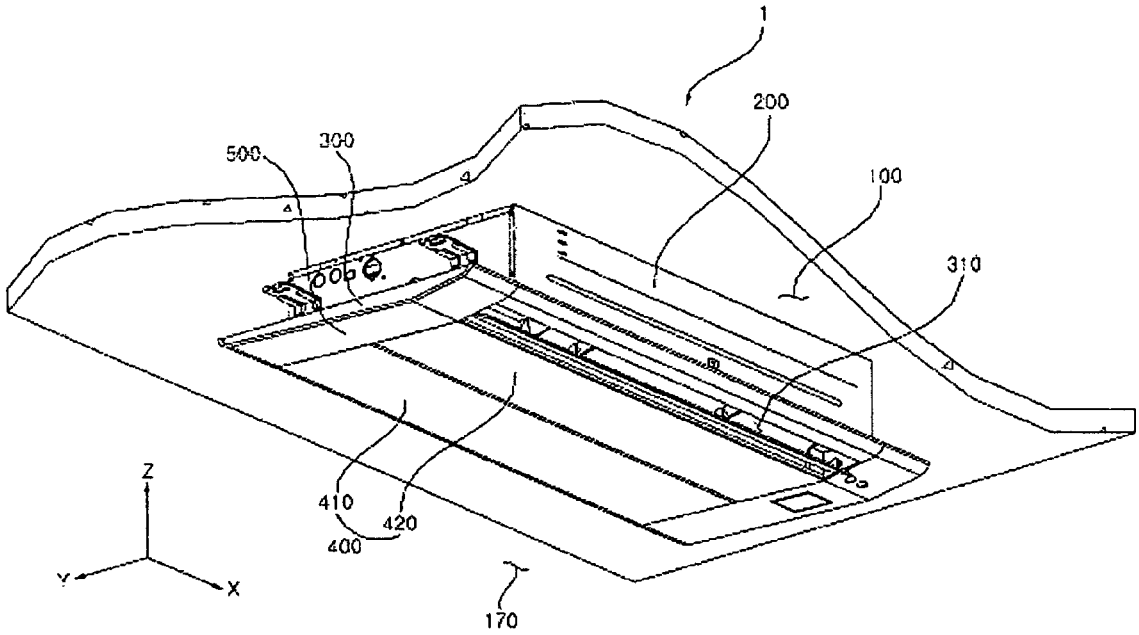
FIG. 1 is a perspective view illustrating a ceiling type air conditioner according to the present invention.
Figure 2:
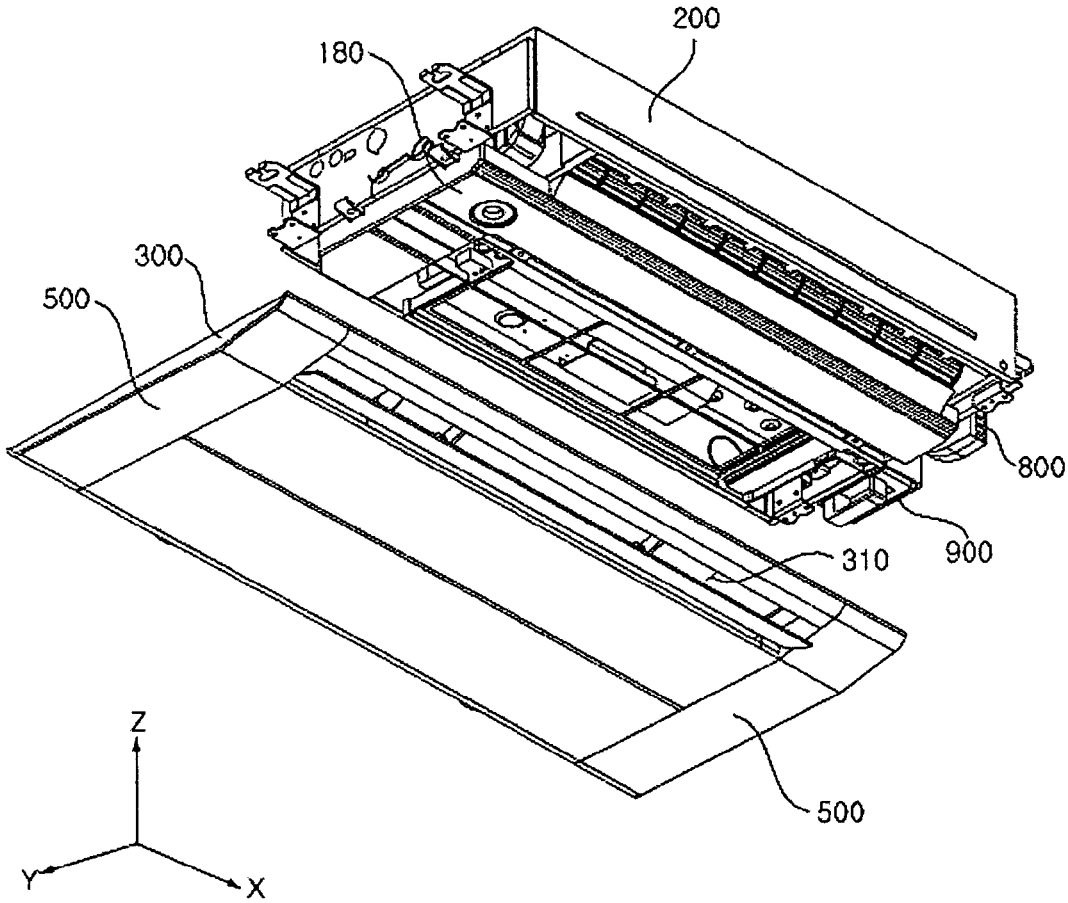
FIG. 2 is a perspective view illustrating a state in which a base panel is separated from the case illustrated in FIG. 1.

FIG. 1 is a perspective view illustrating a ceiling type air conditioner 1 according to the present invention. FIG. 2 is a perspective view illustrating a state in which a base panel 300 is separated from the case 200 illustrated in FIG. 1.

Hereinafter, for convenience sake, in FIGS. 1 and 2, the longitudinal direction, that is, the right-to-left direction of the case 200 is denoted by reference numeral X, a direction horizontally orthogonal to the longitudinal direction of the case 200, that is, a front-to-rear direction is denoted by reference numeral Y, and a direction orthogonal to the longitudinal direction of the case 200, that is, an up-to-down direction is denoted by reference numeral Z.

Referring to FIGS. 1 and 2, the ceiling type air conditioner 1 according to the present invention includes the case 200 fixed to the internal space of the ceiling 100 to suction the air and to discharge the heat-exchanged air. The case 200 can be a rectangular parallelepiped whose bottom is opened and whose longitudinal sides are longer than the other sides.

The case 200 is fixed by fastening tools such as a bolt (not shown) to be closely attached to the ceiling 100. Various heat-exchanging components 180 for suctioning the air in a lower space 170 to perform heat-exchange and to discharge the heat-exchanged air are provided in the case 200. The ceiling type air conditioner 1 further includes a base panel 300 coupled to the bottom of the case 200 to cover the opened bottom of the case 200.

A front panel 400 for opening and closing an air suctioning hole 305 is provided on the bottom of the base panel 300. The front panel 400 opens the air suctioning hole 305 formed in the base panel 300 to guide the suctioned air to the case 200 when the air conditioner operates and closes the air suctioning hole 305 to form the external appearance of the bottom of the ceiling 100 when the air conditioner does not operate.

The ceiling air conditioner 1 further includes side panels 500 provided on the base panel 300 corresponding to at least one side of the front panel 400. The side panels 500 can be coupled to the base panel 300 so that a user can selectively attach the side panels 500 to the base panel 300 and detach the side panels 500 from the base panel 300. The side panels 500 are provided on the bottom of the base panel 300 to form a part of the external appearance of the air conditioner 1.

Figure 3:
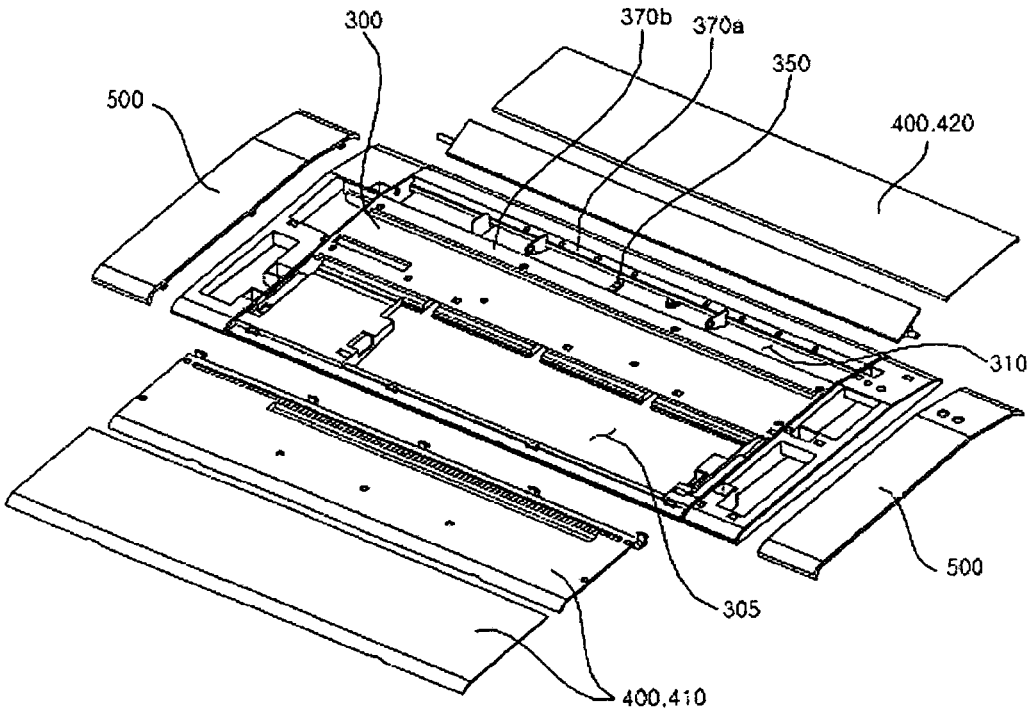
FIG. 3 is an exploded perspective view illustrating components coupled to the base panel illustrated in FIG. 1.

FIG. 3 is an exploded perspective view illustrating components coupled to the base panel illustrated in FIG. 1. Referring to FIG. 3, the air suctioning hole 305 for having the inside communicate with the outside of the case 200 is longitudinally formed in the base panel 300 in an X-direction and an air discharging hole 310 for having the inside communicate with the outside of the case 200 is formed in a position separated from the air suctioning hole 305 by a predetermined distance in an Y-direction to run parallel with the air suctioning hole 305. The air suctioning plane of the air suctioning hole 305 and the air discharging plane of the air discharging hole 310 can be provided to be actually parallel with respect to a horizontal plane.

Figure 4:
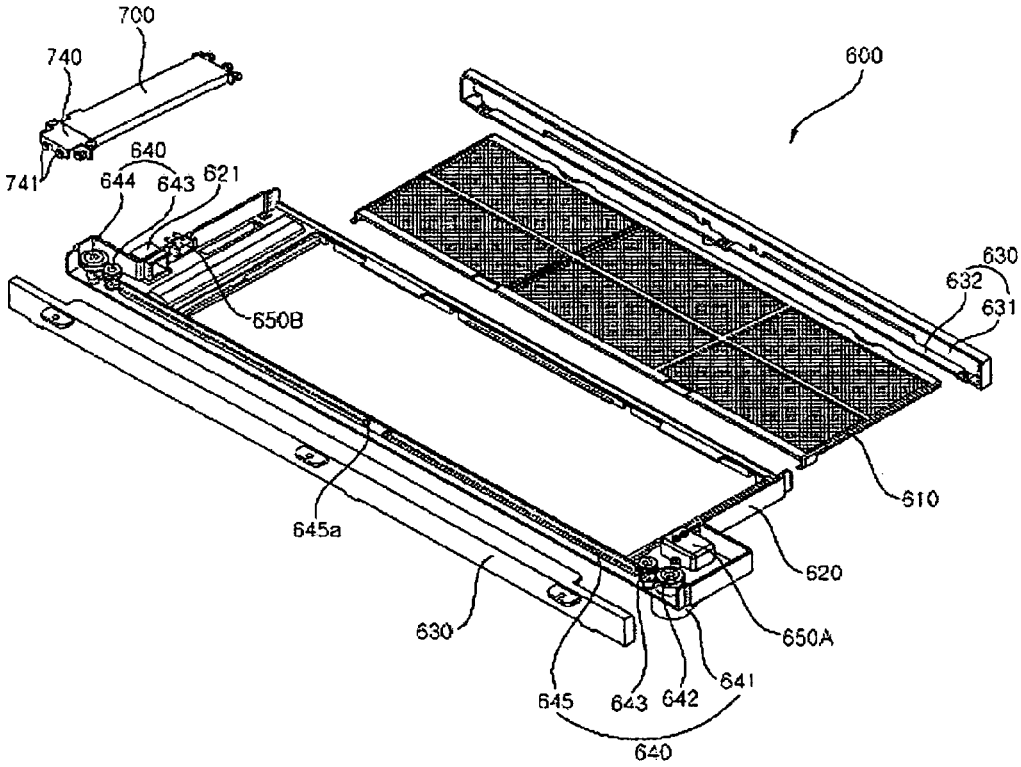
FIG. 4 is an exploded perspective view illustrating a cleaning device coupled to the air suctioning hole of the base panel illustrated in FIG. 1.
Figure 5:
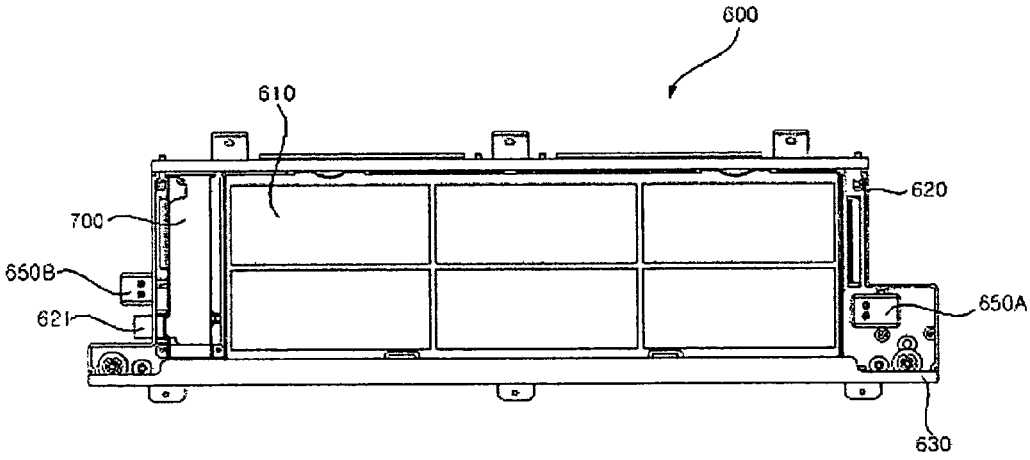
FIG. 5 is a perspective view illustrating the assembly of the cleaning device illustrated in FIG. 4.
Figure 6:
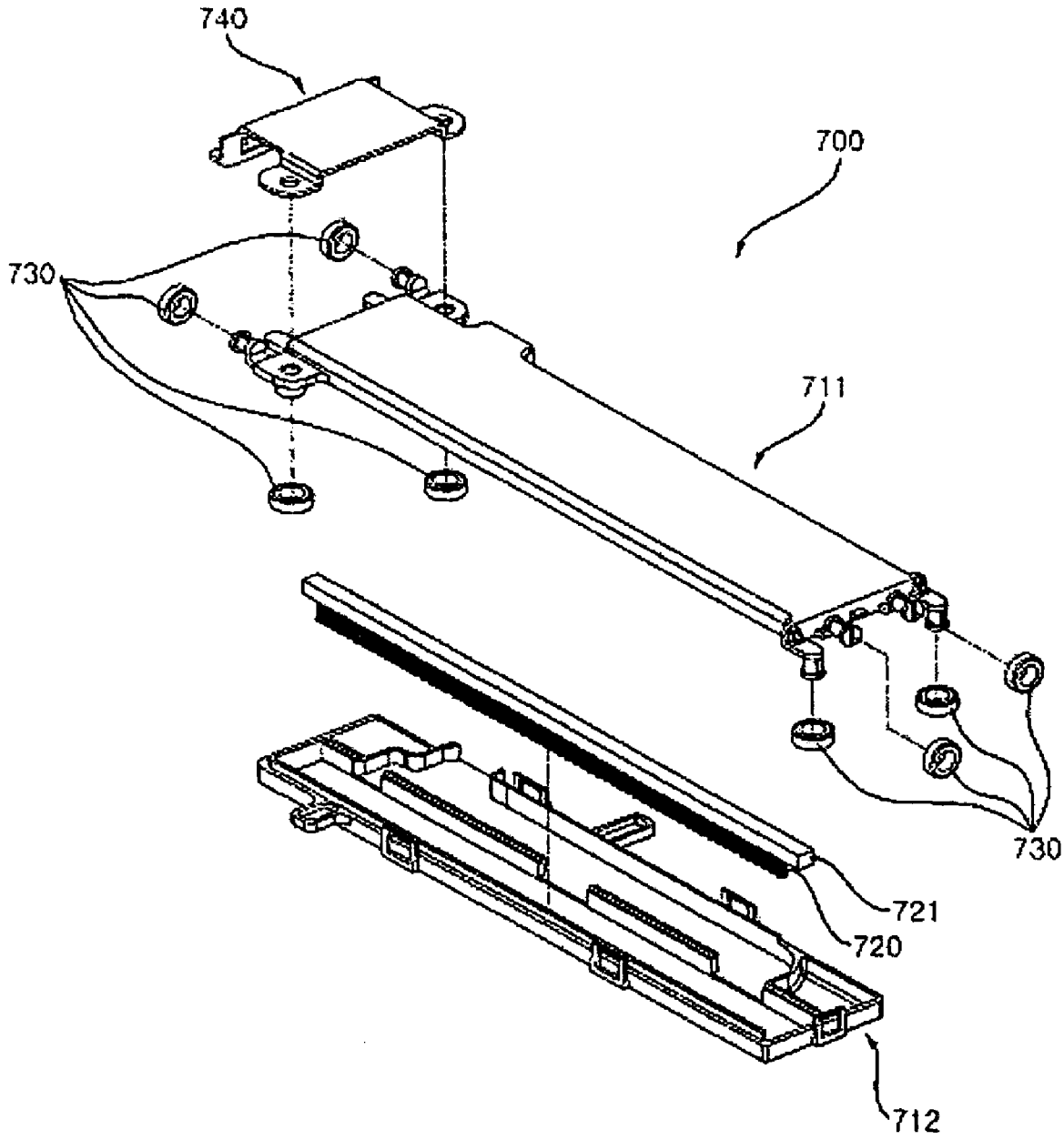
FIG. 6 is an exploded perspective view of the brush assembly illustrated in FIG. 4.

FIG. 4 is an exploded perspective view illustrating a cleaning device 600 coupled to the air suctioning hole 305 of the base panel 300 illustrated in FIG. 1. FIG. 5 is a perspective view illustrating the assembly of the cleaning device 600 illustrated in FIG. 4. FIG. 6 is an exploded perspective view of the brush assembly 700 illustrated in FIG. 4.

The cleaning device 600 according to the present invention includes a filter 610, a filter housing 620 in which the filter 610 is mounted, and a brush assembly 700.

First, the filter 610 for filtering foreign matters in the air introduced through the air suctioning hole 305 is provided in the air suctioning hole 305. As illustrated in FIG. 4, the filter 610 is settled in the filter housing 620 provided in the air suctioning hole 305. The filter 610 can be attached to and detached from the filter housing 620 so that the user can exchange the filter 610. Therefore, the filter 610 can be fitted into or can slide to be coupled to the filter housing 620. However, the present invention is not limited to the above.

The filter 610 and the filter housing 620 are manufactured based on the size of the air suctioning hole 305 to be coupled to the air suctioning hole 305 by the above-described fitting or sliding method. However, the present invention is not limited to the above. Since the filter 610 collects the foreign matters in the air suctioned through the air suctioning hole 305, the amount of the foreign matters collected by the filter 610 increases with the lapse of time for which the filter 610 is used.

Referring to FIGS. 4 and 5, the brush assembly 700 is coupled to the filter housing 620 and is provided under the filter 610. Referring to FIG. 6, the brush assembly 700 includes a brush 720 and a main body 710.

The main body 710 contacts the brush 720 to form a predetermined space in which the foreign matters separated from the filter 610 are collected and stored. To be specific, the main body 710 includes a main body base 711 that forms the bottom of the main body 710 and a main body cover 712 for covering the main body base 711.

At least one supporting units (722 of FIG. 8 to be described later) protrude on the bottom of the main body base 711 and a brush frame 721 is coupled onto the supporting units 722.

The brush 720 is fixed to the brush frame 721 provided in the main body 710. The brush 720 is provided under the filter 610 to contact the foreign matters filtered by the filter 610 and drop the foreign matters in a gravitational direction.

Since the brush 720 contacts the filter 610, the foreign matters filtered by the filter 610 drop in the gravitational direction to be stored in the main body base 711.

To be specific, the brush 720 is provided under the filter 610 and the moving unit 640 and the brush assembly 700 are connected to each other. The brush assembly 700 can be moved by the moving unit 640 in one direction of the filter housing 620. When the brush assembly 700 moves in one direction (the X-direction of FIG. 1) of the filter housing 620, the brush 720 contacts the filter 610. Since the brush 720 contacts the filter 610, the foreign matters separated from the filter 610 drop in the gravitational direction to be accumulated on the main body 710.

Referring to FIG. 6, the brush assembly 700 further includes a plurality of rollers 730 provided between the filter housing 620 and the main body 710. When the brush assembly 700 is moved by the moving unit 640, the rollers 730 roll along one side of the filter housing and the brush assembly 700 moves based on the rolling operation.

Referring to FIG. 4, the filter housing 620 includes movement guiding units 630 for supporting both sides of the main body 710 to guide the movement of the brush assembly 700 and to prevent the main body 710 from being separated downward on at least one sides of the filter housing 620.

Figure 7:
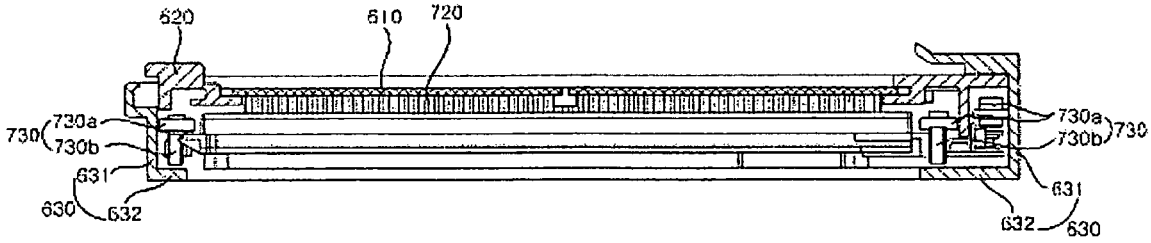
FIG. 7 is a side view illustrating the cleaning device illustrated in FIG. 4.

FIG. 7 is a side view illustrating the cleaning device 600 illustrated in FIG. 4. Referring to FIGS. 4 and 7, the movement guiding units 630 include supporting surfaces 631 extended downward from both ends parallel with the longitudinal direction of the filter housing 620 to support both ends of the brush assembly 700 in the longitudinal direction of the brush assembly 700 and separation preventing surfaces 632 extended from the ends of the supporting surfaces 631 to run parallel with the filter housing 620 to prevent the brush assembly 700 from being separated downward.

The movement guiding units 630 are provided at least on one sides of the filter housing 620. As illustrated in FIG. 7, the movement guiding units 630 can be provided on both sides of the filter housing 620 to support both ends of the brush assembly 700.

The plurality of rollers 730 are provided in the movement guiding units 630 to roll. To be specific, the plurality of rollers 730 are provided on both ends of the brush assembly 700 and include horizontal rollers **730*a* and vertical rollers 730*b* in each end. The horizontal rollers 730*a* prevent the brush assembly 700 from being separated in a lateral direction and the vertical rollers 730*b* prevent the brush assembly 700** from being separated in a vertical direction.

To be specific, the horizontal rollers **730*a* are provided to support and to be supported by the supporting surfaces 631 to roll and the vertical rollers 730*b* are provided to support and to be supported by the separation preventing surfaces 632 to roll. The brush assembly 700 is supported by the plurality of rollers 730 in the horizontal direction and the vertical direction. At the same time, when the brush assembly 700 moves along one direction (the X-direction of FIG. 1) of the filter housing 620**, a twisting or shaking phenomenon in the horizontal or vertical direction can be prevented.

On the other hand, the cleaning device 600 according to the present invention further includes the moving unit 640 for moving the brush assembly 700.

The moving unit 640 moves the brush assembly 700 along one direction (the X direction of FIG. 1) of the filter housing 620. To be specific, the movable unit 640 includes a driving motor 641 provided on at least one side of the filter housing 620 and a power transmitting unit coupled to the brush assembly 700 to transmit the power of the driving motor 641 to the brush assembly 700. Therefore, the brush assembly 700 is coupled to the filter housing 620 to be moved by the power transmitting unit in one direction of the filter housing 620.

The power transmitting unit includes a driving pulley 642, a driven pulley 644, a tension pulley 643, and a wire belt 645.

The driving pulley 642 is connected to the rotary shaft of the driving motor 641. When the rotary shaft of the driving motor 641 is rotated by a power source applied from a power supply (not shown), the driving pulley 642 is driven to rotate. The driven pulley 644 is provided on the other side of the filter housing 620 in which the driving pulley 642 is provided.

The wire belt 645 is wound around the driving pulley 642 and is connected to the brush assembly 700 to transmit the driving force of the driving motor 641 to the brush assembly 700. The brush assembly 700 is connected to the wire belt 645 as follows.

Referring to FIG. 4, a wire connecting unit 740 to which the wire belt 645 is connected is formed on one side of the brush assembly 700 and fixing units 741 are formed in the wire connecting unit 740. Rings 645*a* are formed in one end and the other end of the wire belt 645 and the rings 645*a* are locked to the fixing units 741 of the wire connecting unit 740. Here, the fixing units 741 are preferably hook-shaped so that the wire belt 645 can be easily attached and detached. In addition, the wire belt 645 can be formed of an elastic material in order to increase contacting force between the driving pulley 642 and the tension pulley 643 or between the driving pulley 644 and the tension pulley 643 or between the driven pulley 644 and the tension pulley 643.

The tension pulley 643 is provided on the traveling path of the wire belt 645 to be separated from the driving pulley 642 and the driven pulley 644 so that the wire belt 645 is wound on one side to generate tension in the wire belt 645.

On the other hand, the plurality of rollers 730 are provided in the movement guiding units 630 to be rolled by the power transmitted from the power transmitting unit. That is, when the power of the driving motor 641 is transmitted to the wire belt 645, the wire belt 645 rotates and is wound so that the rollers 730 of the brush assembly 700 roll along the supporting surfaces 631 and the separation preventing surfaces 632 of the movement guiding units 630.

Figure 8:
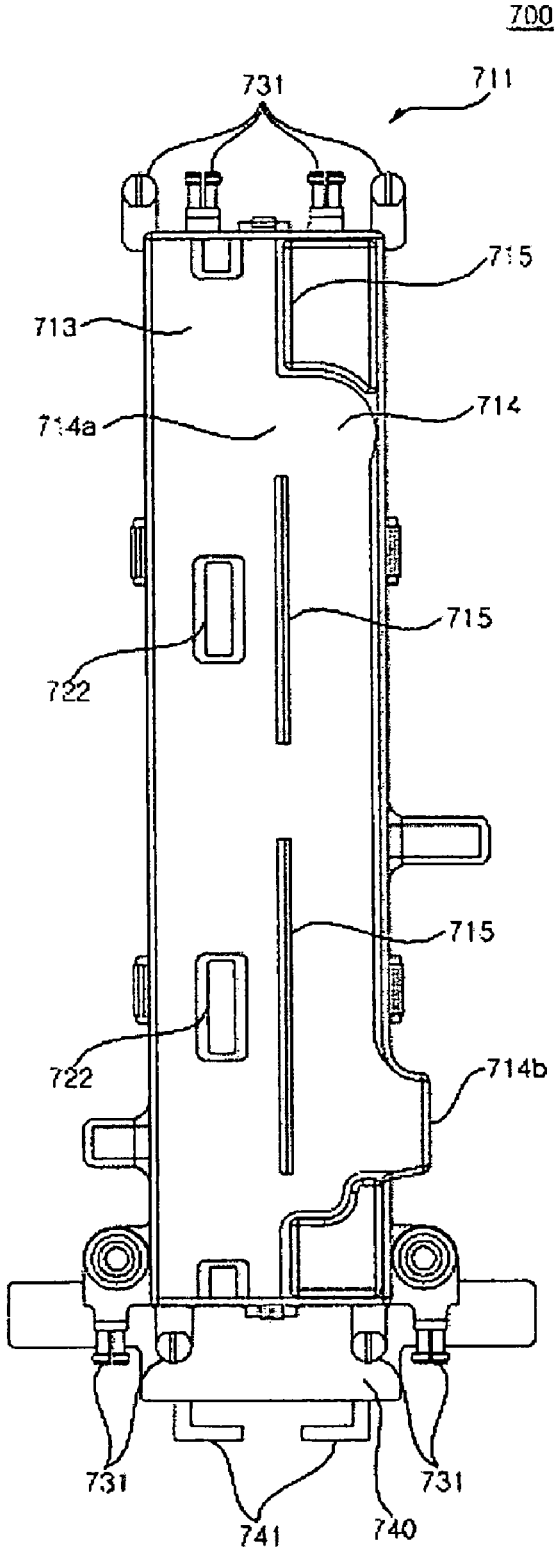
FIG. 8 is a plan view of the brush assembly illustrated in FIG. 4.
Figure 9:
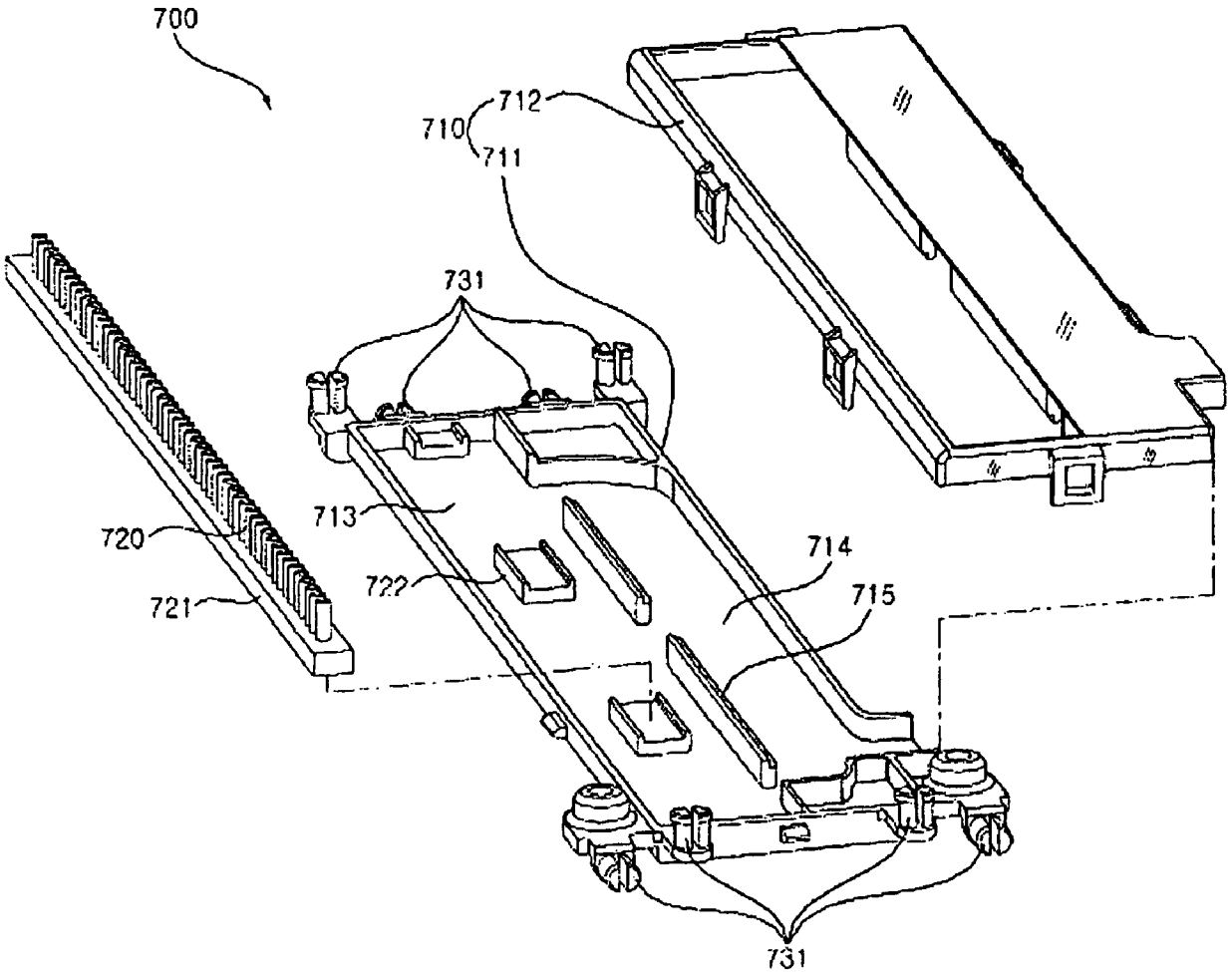
FIG. 9 is an exploded perspective view of the brush assembly illustrating the inside of the main body of the brush assembly illustrated in FIG. 4.

FIG. 8 is a plan view of the brush assembly illustrated in FIG. 4. FIG. 9 is an exploded perspective view of the brush assembly illustrating the inside of the main body of the brush assembly illustrated in FIG. 4.

As described above, the wire connecting unit 740 to which the wire belt 645 is connected is formed on one side of the brush assembly 700. The fixing units 741 to which both ends of the wire belt 645 are locked are formed in the wire connecting unit 740 and the fixing units 741 are hook-shaped. The rings (645*a* of FIG. 4) are formed in one end and the other end of the wire belt 645 and the rings 645*a* are locked to the fixing units 741 of the wire connecting unit 740.

The inside of the main body 710 is partitioned off into a settling unit 713 in which the foreign matters drop in the gravitational direction to be settled and a guiding unit 714 for guiding the foreign matters settled in the settling unit 713 to the outside of the main body 710. Here, partitions 715 for partitioning off between the settling unit 713 and the guiding unit 714 are formed in the main body 710. A plurality of suctioning holes 714*a* are formed between the partitions 715 to be separated from each other. A discharging hole 714*b* for discharging the foreign matters settled in the settling unit 713 to the outside of the main body 710 is formed on one side of the guiding unit 714.

The main body base 711 and the main body cover 712 are fitted into each other. The main body cover 712 does not cover the entire surface of the main body base 711 but covers only the guiding unit 714. This is because the settling unit 713 is to be exposed to the outside in order to have the foreign matters drop from the filter 610 by the brush 720 and settled and to have the brush 720 and the brush frame 721 provided.

The cleaning device 600 according to the present invention further includes the suctioning unit 800 for suctioning the foreign matters collected by the brush assembly 700 and a foreign matter collecting unit 900.

As illustrated in FIG. 2, the suctioning unit 800 is provided outside the case 200. When the brush assembly 700 is moved by the moving unit 640 to one end of the filter housing 620, the brush assembly 700 and the suctioning unit 800 communicate with each other.

The suctioning unit 800 includes a suction force generating unit (not shown) for generating suction force suctioning the foreign matters collected by the brush assembly 700 and a foreign matter collecting unit (not shown) for suctioning the foreign matters from the brush assembly 700 by the suction force generated by the suction force generating unit.

Referring to FIGS. 4 and 8, when the brush assembly 700 is moved by the moving unit 640 to one end of the filter housing 620, the discharging unit 714*b* formed in the guiding unit 714 of the main body 710 and a housing discharging unit 621 formed in the filter housing 620 are connected to each other. The housing discharging hole 621 and the suctioning hole (not shown) formed in the foreign matter collecting unit communicate with each other so that the brush assembly 700 and the suctioning unit 800 can communicate with each other. The housing discharging hole (not shown) and the suctioning hole (not shown) formed in the foreign matter collecting unit are directly coupled to each other to communicate with each other, however, can communicate with each other using a hose (not shown).

When the foreign matter collecting unit and the guiding unit 714 communicate with each other, the foreign matters are suctioned by the suction force generated by the suction force generating unit into the foreign matter collecting unit through the settling unit 713 and the guiding unit 714. The dust suctioned into the foreign matter collecting unit is centrifuged to be collected by and stored in the foreign matter collecting unit 900.

On the other hand, referring to FIG. 2, the cleaning device 600 according to the present invention further includes a controlling unit 660 for controlling the operation of at least one of the moving unit 640 or the suctioning unit 800. As illustrated in FIG. 2, the controlling unit 660 can be provided outside the case 200, however, can be included in a control body (not shown) including electric components and can be provided anywhere in the case 200.

The controlling unit 660 controls the operation of at least one of the moving unit 640 or the suctioning unit 800 based on the position of the brush assembly 700 on the filter housing 620 when the brush assembly 700 moves on the filter housing 620.

Referring to FIGS. 4 and 5, the cleaning device 600 according to the present invention further includes a position sensing unit 650A and 650B. The position sensing unit 650A and 650B is provided on at least one side of the filter housing 620 to sense the position of the brush assembly 700.

The controlling unit 660 receives electric signals generated by the position sensing unit 650A and 650B to control the operation of at least one of the moving unit 640 and the suctioning unit 800. Referring to FIG. 4, the position sensing unit 650A and 650B can be provided on both ends of the filter housing 620 in a longitudinal direction. Here, positions on the filter housing 620 where the position sensing unit 650A and 650B is provided are defined as a first position and a second position and the position sensing unit provided on the first position and the second position is defined as the first signal unit 650A and the second signal unit 650B.

The first signal unit 650A and the second signal unit 650B can be switches for generating electric signals when no less than predetermined pressure is applied due to contact with the brush assembly 700. However, the first signal unit 650A and the second signal unit 650B are not limited to the switches. Any sensor for sensing the access of the brush assembly 700 can be used.

When the brush assembly 700 moves in the longitudinal direction of the filter housing 620 to reach the first position through the plurality of rollers 730, the first signal unit 650A generates an electric signal. When the signal generated by the first signal unit 650A is transferred to the controlling unit 660 and the controlling unit 660 receives the signal from the first signal unit 650A, a command of moving the brush assembly 700 to the opposite direction of a traveling direction is transmitted to the moving unit 640. Therefore, the operation direction of the moving unit 640 is reversed and the brush assembly 700 moves to the opposite direction of the traveling direction.

On the other hand, when the brush assembly 700 slides in the longitudinal direction of the filter housing 620 to reach the second position, the second signal unit 650B generates an electric signal. When the signal generated by the second signal unit 650B is transferred to the controlling unit 660 and the controlling unit 660 receives the signal from the second signal unit 650B, a command of stopping the brush assembly 700 for a first set time is transmitted to the moving unit 640.

To be specific, when the brush assembly 700 reaches the second position that is one end of the filter housing 620 by the moving unit 640, the brush assembly 700 and the suctioning unit 800 communicate with each other. That is, the discharging hole 714*b* formed in the guiding unit 714 of the main body 710 and the housing discharging hole 621 formed in the filter housing 620 communicate with each other and the housing discharging hole 621 and a suctioning hole (not shown) formed in the foreign collecting unit communicate with each other so that the brush assembly 700 and the suctioning unit 800 can be connected with each other.

The controlling unit 660 controls the moving unit 640 based on the signal transferred from the second signal unit 650B so that the brush assembly 700 stops for the first set time. That is, the second signal unit 650B generates an electric signal including information indicating that the brush assembly 700 reaches the second position to transmit the electric signal to the controlling unit 660 and the controlling unit 660 generates an electric command of stopping the brush assembly 700 for the first set time. The controlling unit 660 transmits the command to the moving unit 640 to stop the operation of the moving unit 640 for the first set time and to stop the brush assembly 700 for the first set time.

When the brush assembly 700 stops for the first set time, the controlling unit 660 controls the operation of the suctioning unit 800 to suction the foreign matters accumulated on the main body 710 of the brush assembly 700. In this case, the controlling unit 660 operates the suctioning unit 800 for the second setting time to suction the foreign matters. While the brush assembly 700 stops, since the foreign matters are suctioned by the suctioning unit 800, the second setting time is smaller than the first set time.

For the second setting time, the foreign matters accumulated on the main body 710 of the brush assembly 700 by the suctioning operation of the suctioning unit 800 are collected by and stored in the foreign matter collecting unit 900.

On the other hand, when the brush assembly 700 reaches the second position, the second signal unit 650B generates an electric signal to transfer the signal to the controlling unit 660 and the controlling unit 660 can determine whether the number of times at which the brush assembly 700 reaches the second position is no less than a predetermined number of times. Whenever the brush assembly 700 reaches the second position, the moving unit 640 or the suctioning unit 800 can operate. However, since the amount of the foreign matters accumulated on the main body 710 of the brush assembly 700 can be minute by only one time of reciprocation, when the brush assembly 700 reaches the second position by no less than predetermined number of times, the suctioning unit 800 is operated to reduce power consumption and operation noise.

In this case, when the brush assembly 700 reaches the second position by a smaller number of times than a predetermined number of times, the controlling unit 660 controls the moving unit 640 so that the brush assembly 700 moves to the opposite direction of the traveling direction.

On the other hand, the controlling unit 660 can control the operation of the moving unit 640 or the suctioning unit 800 based not on the number of times at which the brush assembly 700 reaches the second position but on the operation time of the ceiling type air conditioner 1.

That is, the controlling unit 660 receives the signal from the second signal unit 660B and then, controls the moving unit 640 so that the brush assembly 700 stops for the first set time when the operation time of the ceiling type air conditioner 1 passes a predetermined time. As the operation time of the ceiling type air conditioner 1 increases, the amount of the foreign matters accumulated on the main body 710 of the brush assembly 700 increases. Therefore, after the operation time of the ceiling type air conditioner 1 passes a predetermined time, the suctioning unit 800 is operated to reduce power consumption and operation noise.

The controlling unit 660 receives the signal from the second signal unit 660B and stops the brush assembly 700 for the first set time when it is determined that the operation time of the ceiling type air conditioner 1 passes a predetermined time. Since the operation in which the brush assembly 700 stops for the first set time is the same as described above, description thereof will be omitted. The controlling unit 660 can control the operation of the suctioning unit 800 while the brush assembly 700 stops for the first set time. As described above, the controlling unit 660 operates the suctioning unit 800 for the second set time. In this case, the second set time is smaller than the first set time.

The controlling unit 660 can control the moving unit 640 so that the brush assembly 700 moves to the opposite direction when the operation time of the ceiling type air conditioner 1 does not pass a predetermined time. Since the controlling of the operation of the moving unit 640 is the same as described above, detailed description thereof will be omitted.

Figure 10:
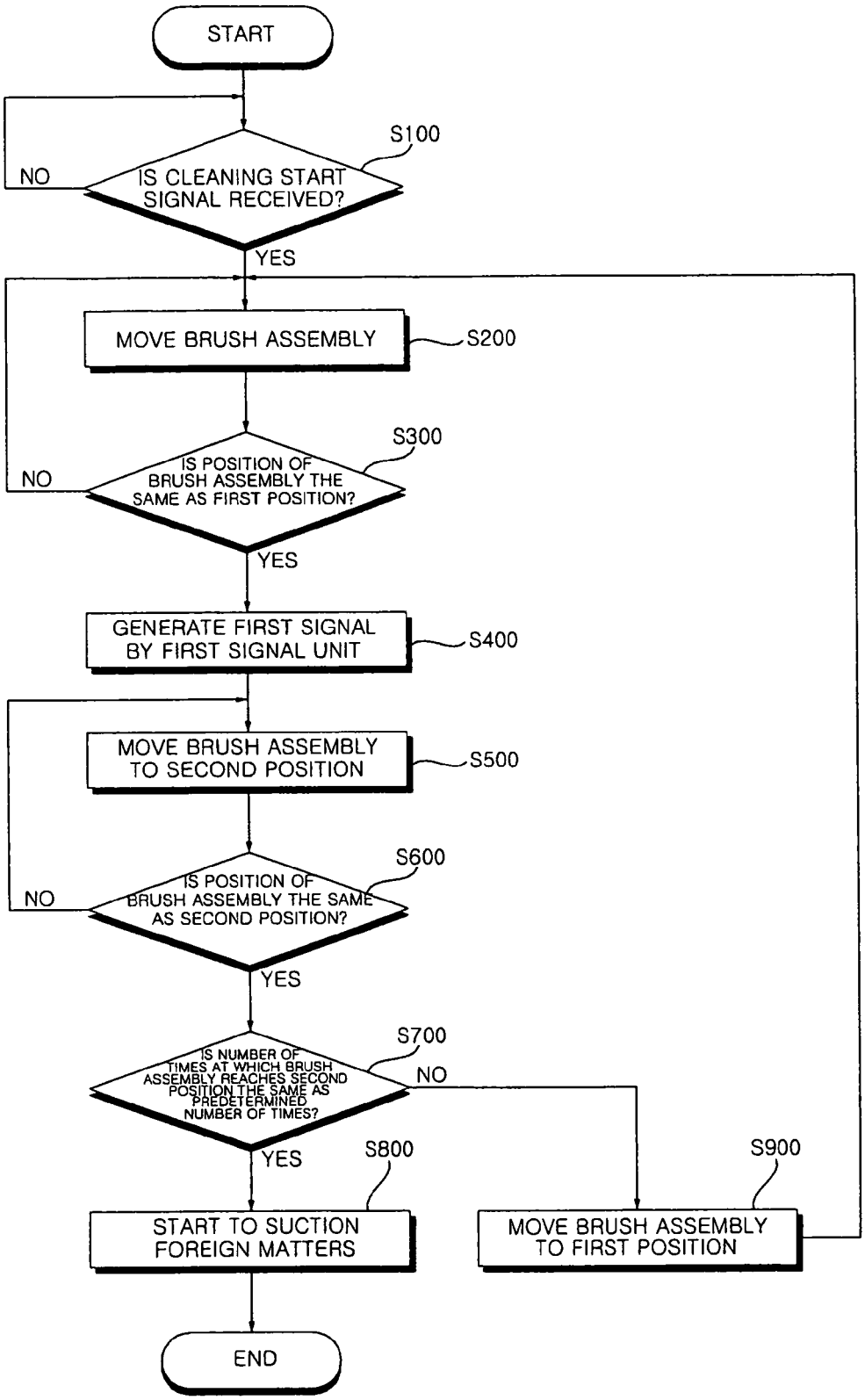
FIG. 10 is a flowchart of the cleaning method of a cleaning device according to an embodiment of the present invention.

FIG. 10 is a flowchart of the cleaning method of a cleaning device according to an embodiment of the present invention. In FIG. 10, the controlling is performed based on the number of times at which the brush assembly 700 reaches the second position. The operation of the cleaning device of the ceiling type air conditioner according to an embodiment of the present invention will be described as follows.

First, the cleaning device 600 receives a cleaning start signal by a user operating a remote controller key (not shown) (S100). When the cleaning device 600 receives the cleaning start signal, the controlling unit 660 moves the brush assembly 700 in one direction of the filter housing 620 (S200). When the brush assembly 700 reaches the first position by the horizontal sliding operation of the brush assembly 700 (S300), the first signal unit 650A generates the first signal (S400). Here, the first signal means the electric signal generated by the first signal unit 650A. The signal generated by the first signal unit 650A is transferred to the controlling unit 660 and the controlling unit 660 moves the brush assembly 700 to the second position that is the opposite direction of the first position (S500).

When the brush assembly 700 reaches the second position by the horizontal direction sliding operation of the brush assembly 700 (S600), the controlling unit 660 determines whether the number of times at which the brush assembly 700 reaches the second position is no less than a predetermined number of times (S700). When it is determined that the number of times at which the brush assembly 700 reaches the second position is no less than a predetermined number of times, the suctioning unit 800 is operated for the second set time so that the brush assembly 700 starts to suction the foreign matters in the main body 710 (S800). The suctioning unit 800 suctions the foreign matters collected by the brush assembly 700 to collect the foreign matters by the foreign matter collecting unit.

When the number of times at which the brush assembly 700 reaches the second position is less than a predetermined number of times, the brush assembly 700 is moved to the first position that is the opposite direction of the second position (S900). As described above, since a user does not have to release the filter 610 from the base panel or the filter housing 620 in order to clean the filter 610, the convenience of the user is improved.

Although the present invention has been described with reference to the embodiment shown in the drawings, these are merely illustrative, and those skilled in the art will understand that various modifications and equivalent other embodiments of the present invention are possible. Consequently, the true technical protective scope of the present invention must be determined based on the technical spirit of the appended claims.

What is claimed is:

1. A ceiling type air conditioner, comprising:

a filter housing in which a filter is settled;

a brush assembly coupled to the filter housing to collect foreign matters filtered by the filter;

a moving unit for moving the brush assembly along the filter housing;

a suctioning unit for suctioning the foreign matters collected by the brush assembly;

a position sensing unit provided on at least one side of the filter housing to sense the position of the brush assembly, wherein the position sensing unit comprises: a first signal unit for generating a first signal when the brush assembly reaches a first position on the filter housing; and a second signal unit for generating a second signal when the brush assembly reaches a second position on the filter housing; and a controlling unit for controlling an operation of both the moving unit and the suctioning unit based on the sensed position of the brush assembly, wherein the controlling unit receives the first signal and then controls the moving unit so that the brush assembly moves in an opposite direction, and wherein the controlling unit receives the second signal and then controls the moving unit so that the brush assembly stops for a first set time when a number of times the brush assembly reaches the second position is no less than a predetermined number of times.

2. The ceiling type air conditioner of claim 1, wherein the brush assembly comprises:

a brush that contacts the foreign matters filtered by the filter; and a main body that contacts the brush to form a predetermined space so that the foreign matters separated from the filter are collected and stored.

3. The ceiling type air conditioner of claim 2, wherein the brush is provided under the filter, and wherein the foreign matters separated from the filter by the brush drop in a gravitational direction to be collected by the main body.

4. The ceiling type air conditioner of claim 1, wherein the brush assembly moves in a longitudinal direction of the filter housing, and wherein the position sensing unit is provided on both ends of the filter housing.

5. The ceiling type air conditioner of claim 1, wherein the position sensing unit is a switch for generating electric signals when a no less than predetermined pressure is applied due to contact with the brush assembly.

6. The ceiling type air conditioner of claim 1, wherein the brush assembly and the suctioning unit communicate with each other when the brush assembly reaches the second position.

7. The ceiling type air conditioner of claim 6, wherein the controlling unit operates the suctioning unit while the brush assembly is stopped for the first set time.

8. The ceiling type air conditioner of claim 6, wherein the controlling unit operates the suctioning unit for a second set time.

9. The ceiling type air conditioner of claim 8, wherein the second set time is smaller than the first set time.

10. The ceiling type air conditioner of claim 1, wherein the controlling unit receives the second signal and then, controls the moving unit so that the brush assembly is moved to an opposite direction when the number of times the brush assembly reaches the second position is less than the predetermined number of times.

11. The ceiling type air conditioner of claim 1, wherein the suctioning unit comprises a suction force generating unit for generating suction force suctioning the foreign matters collected by the brush assembly and a foreign matter collecting unit for suctioning the foreign matters from the brush assembly by the suction force generated by the suction force generating unit, and wherein the foreign matters collected by the brush assembly are suctioned by the foreign matter collecting unit when the suction force generating unit operates.

12. The ceiling type air conditioner of claim 1, further comprising a foreign matter collecting unit for collecting the foreign matters suctioned by the suctioning unit to be discharged.

* * * * *